US011624119B2

(12) United States Patent
Loop

(10) Patent No.: US 11,624,119 B2
(45) Date of Patent: Apr. 11, 2023

(54) CENTRIFUGAL MOLTEN ELECTROLYSIS REACTOR FOR OXYGEN, VOLATILES, AND METALS EXTRACTION FROM EXTRATERRESTRIAL REGOLITH

(71) Applicant: Thomas E Loop, Seattle, WA (US)

(72) Inventor: Thomas E Loop, Seattle, WA (US)

( * ) Notice: Subject to any disclaimer, the term of this patent is extended or adjusted under 35 U.S.C. 154(b) by 0 days.

(21) Appl. No.: 17/013,584

(22) Filed: Sep. 5, 2020

(65) Prior Publication Data

US 2022/0025535 A1 Jan. 27, 2022

Related U.S. Application Data

(60) Provisional application No. 63/056,695, filed on Jul. 26, 2020.

(51) Int. Cl.

| | |
|---|---|
| ***C25C 7/06*** | (2006.01) |
| ***C25C 3/08*** | (2006.01) |
| ***C25C 7/00*** | (2006.01) |
| ***C25C 3/00*** | (2006.01) |

(52) U.S. Cl.

CPC ..... *C25C 7/005* (2013.01); *C25C 3/00* (2013.01)

(58) Field of Classification Search

CPC .. C25C 3/00; C25C 7/005; C25C 5/04; C25C 7/06; C25C 3/08; C25C 7/00

See application file for complete search history.

(56) References Cited

U.S. PATENT DOCUMENTS 4,869,790 A * 9/1989 Charles ..... C25C 7/005 204/247
2009/0269273 A1* 10/2009 Burton ..... C01B 13/0248 423/579
2016/0251763 A1* 9/2016 Benedetto ..... C25B 9/65 205/342

* cited by examiner

*Primary Examiner* — Zulmariam Mendez
(74) *Attorney, Agent, or Firm* — Thomas E. Loop

(57) ABSTRACT

A centrifugal molten regolith electrolysis (MRE) reactor that can volatilize and capture volatiles (i.e., $^3$He or other noble gases) and electrochemically decompose, while under centrifugal action, lunar regolith into oxygen, metals, and semiconductor materials is disclosed. The high-temperature centrifugal MRE reactor comprises four principal components; namely: (1) a rotatable concentric electrolytic cell comprising an outer metallic shell cathode positioned about an inner central drum anode; (2) a motor sized and configured to rapidly spin (rotate) the concentric electrolytic cell reactor about its central longitudinal axis; (3) a stationary (relative to the spinning electrolytic cell) induction coil (connected to an external stationary AC current source) wrapped about, and adjacent to, the rotatable concentric electrolytic cell (for, when selectively energized, melting regolith contained within the concentric electrolytic cell); and (4) a stationary voltage source (for supplying an applied voltage to the concentric electrolytic cell). The centrifugal MRE reactor electrowins metals and oxygen.

4 Claims, 5 Drawing Sheets

CENTRIFUGAL MOLTEN ELECTROLYSIS REACTOR FOR OXYGEN, VOLATILES, AND METALS EXTRACTION FROM EXTRATERRESTRIAL REGOLITH

CROSS-REFERENCE TO RELATED APPLICATIONS

This application claims the benefit of priority to U.S. Provisional Application No. 63/056,695 filed on Jul. 26, 2020, which application is incorporated herein by reference in its entirety for all purposes.

TECHNICAL FIELD

The present invention relates generally to electrochemical reaction of oxide materials and, more particularly, to electrolysis of molten extraterrestrial regolith.

BACKGROUND OF THE INVENTION

An extended human presence on the Moon is likely to be beneficial for both scientific and economic reasons (Spudis 1996, 2005; Crawford 2004). In order for this aspiration to become a reality, significant technological advances are required in lunar in-situ resource utilization (ISRU) (Anand et al., 2012; Just et al., 2020).

The Moon's surface is covered in several meters of a granular material known as regolith, which material is a mixture of rocks, fine-grained minerals, and glassly particles (McKay et al., 1991). Regolith has been created by the impact of asteroids, comets, and their debris over our Solar System's 4.5 billion years history, and by the effects of radiation as well as solar wind (Horz et al., 1991; Lucey et al., 2006). Lunar regolith is primarily composed of plagioclase, pyroxene, olivine, and ilmenite, and each of these minerals are composed of oxides, including iron(II) oxide (FeO), silica ($SiO_2$), alumina ($Al_2O_3$), titania ($TiO_2$), magnesia (MgO), and calcium oxide (CaO) (Schreiner et al. 2016). Lunar regolith contains more than 40% oxygen by weight, which, if extracted, could be used in life support systems and as a propellant (Lewis et al., 1993; Eckart, 1999; Anand et al., 2012; Badescu, 2012; Crawford, 2015; Just et al., 2020). Several techniques for oxygen extraction from regolith have been proposed and are currently being investigated (Badescu, 2012; Schwandt et al., 2012; Just et al., 2020), including, for example, hydrogen reduction (Allen et al., 1996), carbo-thermal reduction (Gustafson et al., 2009), and molten salt electrolysis (i.e., the FFC Cambridge process) (Schwandt et al., 2010).

The use of lunar regolith in support of a permanent human presence on the Moon, however, goes beyond oxygen extraction. Lunar regolith will also be used for in-situ manufacturing and habitat construction, where a range of technologies are currently being investigated and/or developed, including: sintering of regolith using concentrated sunlight (Meurisse et al., 2018), selective separation sintering (Romo et al., 2018), microwave processing (Allan et al., 2013), 3D printing for building habitats (Cesaretti et al., 2014), selective laser melting (Goulas et al., 2018), and direct laser fabrication (Balla et al., 2012). Further applications include radiation protection, metal production, and the extraction of solar wind implanted volatiles (i.e., $^3He$ or other noble gases) (Just et al., 2020).

As noted by several researchers, regolith may be melted and electrolyzed in a promising new approach known as Molten Regolith Electrolysis (MRE), also sometimes referred to as Magma or Molten Oxide Electrolysis (Colson and Haskin 1992, 1993; Curreri et al., 2006; Sacksteder and Sanders 2007; Sirk et al., 2010; Standish 2010; Vai et al., 2010; Schwandt et al. 2012; Sibelle and Dominguez 2012; Schreiner et al., 2016). This emerging electrochemical process reduces (decomposes) the mineral components that makeup extraterrestrial regolith (which are generally oxides as previously noted), to thereby liberate oxygen (at the anode) and create two molten material streams: a "mongrel alloy" of iron, aluminum, titanium, silicon and trace metals (at the cathode); and a slag portion of unreduced oxides (in the middle portion between the anode and the cathode). The properties of the resulting mongrel alloy have not been comprehensively measured, but are expected to exhibit some ductility and improved tensile strength compared to just melted or sintered regolith (Mueller et al., 2016). Other advancements in MRE include multi-physics simulations of specific reactor designs (Schreiner et al., 2016), which simulations have quantified the material throughput rates and energy requirements of possible MRE systems—demonstrating that MRE scales appropriately for space construction projects.

Although some progress has been made in recent years in the advancement of regolith extraction technologies, there still exists a need in the art for better and more capable MRE cells, reactors, systems and related methods (MRE technologies) that, in addition to oxygen and volatiles extraction, can also produce substantially pure metals and metalloids from regolith's constituent oxides (thereby avoiding or minimizing the production of mongrel alloys). My invention fulfills these needs and provides for further related advantages.

SUMMARY OF THE INVENTION

In brief, my invention, in a first embodiment, is directed to a novel rotating shell and drum molten regolith electrolysis (MRE) reactor that can (1) volatilize and capture volatiles (i.e., $^3He$ or other noble gases) and (2) electrochemically decompose, while under centrifugal action, lunar regolith into oxygen, metals, and semiconductor materials. The proposed continuous-feed reactor design provides a viable alternative for enhanced in-situ resource utilization (ISRU) on the Moon. In my proposed reactor design, the traditional tightly spaced "multi-stack" parallel square plate or circular disc electrode cell configuration (associated with conventional electrolysis cells) are replaced in favor of a new type of rotating cylindrical cell design—a new type of cell design that, unlike conventional multiple stack designs (with their concomitant $O_2$ transport and removal problems), consists of only two large surface area cylindrical electrodes; namely, (1) an outer rotating cylindrical shell that serves as the cathode (and as the reactor containment vessel), and (2) an inner concentrically positioned drum that serves as the anode.

In this novel configuration, and because the shell and concentric drum are rotating about a central longitudinal axis, regolith introduced into the top of the rotating reactor (through an upper multi-passageway rotary union) will be flung against the inner wall of the outer shell where it will be rapidly melted. The outer shell (and inner drum) are made of refractory metals; and, as such, the outer metallic shell may be heated inductively (by means of a surrounding stationary induction coil). The supplemental heat energy provided through selective electromagnetic induction heating (in addition to the Joule heating provided by electrolysis) aids in regolith melting, flowability, and temperature control.

In addition, and to facilitate rapid melting of the regolith (and to ensure superior metal reduction and separation), small amounts of a suitable fluxing/thermite agent may be admixed with the regolith feedstock (in an estimated amount of about 1-part fluxing/thermite agent per 10,000 to 100,000 parts of regolith by weight). After melting, electrolysis begins when the molten regolith flows downwardly along the inner shell wall and into the annular space existing between the outer shell (cathode) and its inner counterpart drum (anode), which is the electrolysis zone. During electrolysis and because of the centrifugal action, the denser liquid metals reduced at the outer cathode will form a thin liquid metal layer against the shell wall (thereby protecting the metallic shell from oxidation), whereas the oxygen evolved (at the inner anode) will be efficiently removed from the anode (through rows of anode through-holes) and vacuum drawn inwardly and into a central tube (and out of the reactor for subsequent liquefaction and storage).

The rotating and downwardly flowing liquid metal layer (consisting essentially of Fe, Si, Al, and Ti) reduced via electrolysis may then be separated from the unreduced and less dense remaining oxide slag overlayer by means of a concentric stationary splitting ring. The stationary splitting ring is concentrically positioned at the bottom of the electrolysis cell roughly halfway between the outer cathode (shell) and the inner anode (drum). In this configuration, the separated layers of liquid metal and molten slag may then be collected in separate underneath reservoirs formed within the interior part of a stationary doughnut-shaped base.

These and other aspects and embodiments of my invention will become more evident upon reference to the following detailed description and attached drawings. It is to be understood, however, that various changes, alterations, and substitutions may be made to the specific embodiments disclosed herein and still be within the scope and extraterrestrial reach of my invention.

BRIEF DESCRIPTION OF THE DRAWINGS

The drawings are intended to be illustrative and symbolic representations of certain exemplary embodiments of my invention (and as such they are not necessarily drawn to scale or to exact dimensional relationships). In addition, it is to be expressly understood that the relative orientations, dimensions, and distances depicted in the drawings (and described in the "Detailed Description of the Invention" section) are exemplary and may be varied in numerous ways without departing from the scope or spirit of my invention (as defined by the claims). Finally, like reference numerals have been used to designate like features throughout the several views of the drawings.

DETAILED DESCRIPTION OF THE INVENTION

Figure 1:
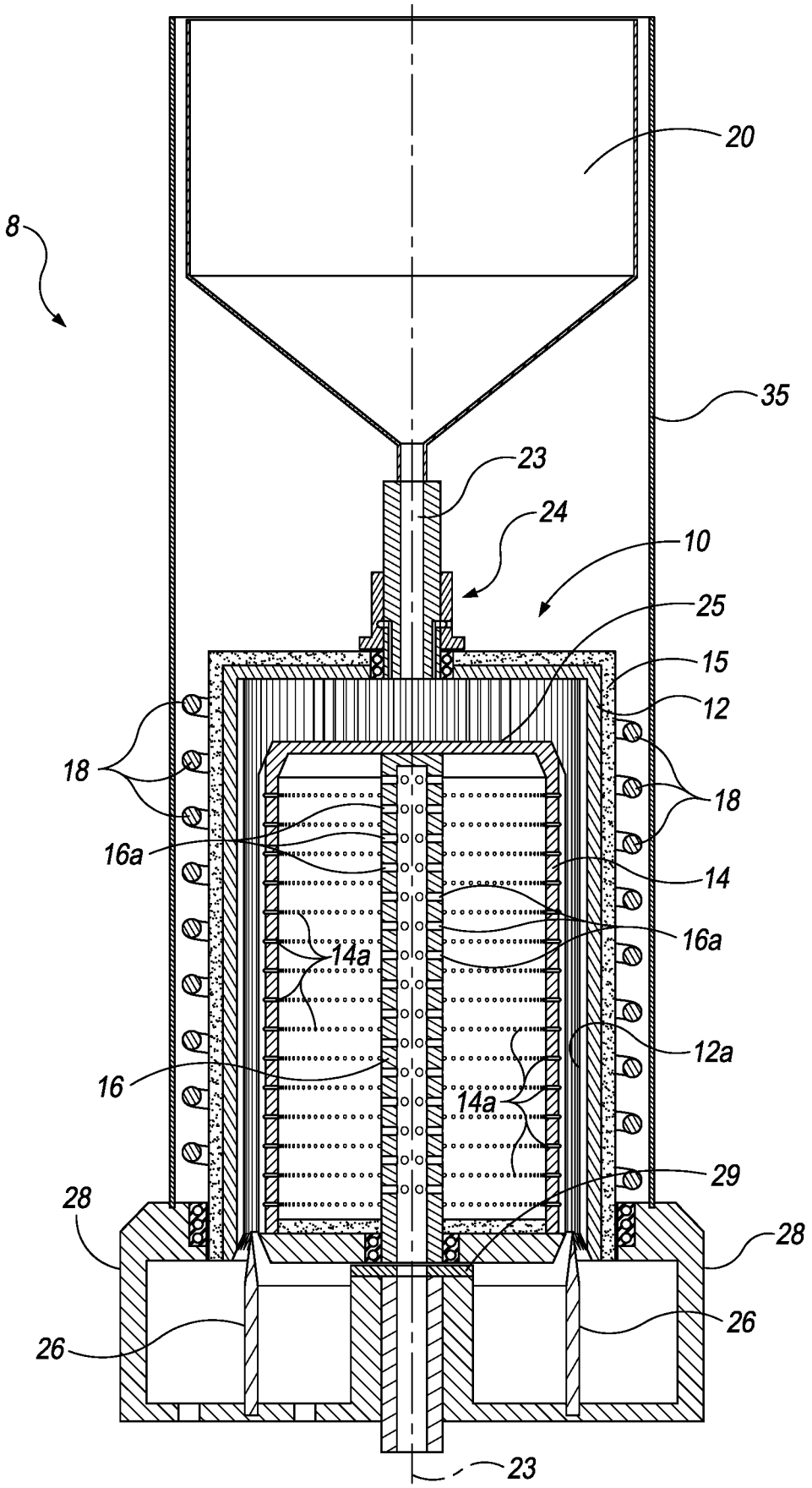
FIG. 1 is a side cross-sectional view of a centrifugal molten regolith electrolysis (MRE) reactor and extraction system in accordance with an embodiment of my invention that shows a rotatable concentric electrolytic cell reactor, an overhead silo, an external surrounding stationary induction coil, a stationary underneath base having concentric inner reservoirs, as well as an internal space between the centrifugal MRE reactor and the silo for housing/system integration of a metering device, a stationary overhead motor, an AC supply, and a voltage source (relative positional locations shown in FIG. 2).

In the following detailed description, reference is made to the accompanying drawings, which form a part hereof. In the drawings, similar symbols or markings have been used to identify like or corresponding elements, unless context dictates otherwise. The illustrative embodiments described in the detailed description, drawings, and claims are not meant to be limiting. Other embodiments may be utilized, and other changes may be made to the various embodiments disclosed herein, without departing from the scope or reach of my invention.

In lunar regolith, approximately 99% of the mass consists of the following 7 major chemical elements: Oxygen (O) (41-45%), Silicon (Si), Aluminum (Al), Calcium (Ca), Iron (Fe), Magnesium (Mg), and Titanium (Ti); whereas nearly all of the remaining 1% consists of the following 4 minor chemical elements: Manganese (Mn); Sodium (Na), Potassium (K), and Phosphorous (P). In addition to these chemical elements, lunar regolith also contains several solar wind implanted elements including hydrogen, helium, nitrogen, and carbon (in amounts generally ranging from about 50-100 ppm by weight).

The chemical composition of lunar regolith has been approximated by NASA by way of different lunar regolith simulants as given below in Table 1.

TABLE 1

Chemical compositions of lunar simulants JSC-1 (NASA, 2015) and NU LHT (NASA, 2008). Composition ranges are given for JSC-1 to reflect the slightly varying compositions of this simulated material.

| Oxide | JSC-1, % by mass | NU LHT, % by mass |
|---|---|---|
| $SiO_2$ | 46-49 | 46.7 |
| $Al_2O_3$ | 14.5-15.5 | 24.4 |
| CaO | 10-11 | 13.6 |
| MgO | 8.5-9.5 | 7.9 |
| $Na_2O$ | 2.5-3 | 1.26 |
| $K_2O$ | 0.75-0.85 | 0.08 |
| $TiO_2$ | 1-2 | 0.41 |
| MnO | 0.15-0.20 | 0.07 |
| FeO | 3-4 | — |
| $Fe_2O_3$ | 7.7.5 | 4.16 |
| $Cr_2O_3$ | 0.02-0.06 | — |
| $P_2O_5$ | 0.6-0.7 | 0.15 |

The oxide materials that make up regolith, when in a molten state, are conductive and may be electrolyzed. In molten regolith electrolysis (MRE), two electrodes are immersed within a molten region (of a container containing molten regolith) and a voltage is applied. The applied voltage drives a current through the molten regolith, thereby decomposing via electrochemical redox reactions the constituent oxide materials into (1) molten metals and metalloids (such as, for example, iron, silicon, aluminum, and titanium) at the cathode, and (2) oxygen gas at the anode. Stated somewhat differently, metal cations are reduced at the cathode to form metals, whereas silicate polymer chains are reduced at the anode to form oxygen gas. Without necessarily prescribing to any particular scientific theory, the primary cathode reactions that produce metal may be generalized as follows:

$$Fe^{2+}+2^{e-}\leftrightarrow Fe^{0} \quad (1)$$

$$Me^{2+}+2^{e-}\leftrightarrow Me^{0} \quad (2)$$

$$Si(IV)+4^{e-}\leftrightarrow Si^{0} \quad (3)$$

Similarly, the primary anode reactions that produce oxygen gas may be generalized as follows:

$$4(SiO^{-})\leftrightarrow 2(Si—O—Si)+O_2+4e^{-} \quad (4)$$

The kinetics of these reactions are extremely fast compared to the current densities achieved during actual molten regolith electrolysis. As such, reaction kinetics is not believed to be a significant restraint on the overall molten oxide decomposition process.

In general terms, the energy requirements for molten silicate/regolith electrolysis depends on the variables L (distance between electrodes), A (surface area of electrodes), $O_2$ eff (efficiency of oxygen production), and k (melt conductivity). In addition, the potential required to drive the reactions is a function of the particular cations reduced and the concentrations of the cations in the melt (noting that the absolute value of the cathode and anode potentials ($E_c$-$E_a$) increases in the order Fe<Si, Ti<Mg, Al<Ca). As the temperature increases (via electrolysis and/or external heating), the molten regolith becomes less viscous and ionic mobility increases.

With that said, it is widely recognized that one of the most challenging design considerations of any MRE reactor is containment of the corrosive molten regolith. For example, crucibles made of ceramic (used in other researchers' MRE cells) are known to fracture (fail) frequently. In order to overcome this shortcoming, I propose to use an iridium or tungsten alloy crucible of the same general type that is used to grow state-of-the-art large ingots, or boules, of single crystals such as, for example, large silicon boules via the Czochralski method, as the molten regolith containment vessel. In the Czochralski crystal growth method, iridium and tungsten alloy crucibles are used to contain and heat (via electromagnetic induction) various multi-component molten silicate oxide materials. For example, large boules of pure silicon crystal are commonly grown via the Czochralski method by touching a seed crystal (positioned at the end of a rod) to a silicon oxide melt, and then rotating and pulling up the rod very slowly (generally over the period of several days). The iridium and/or tungsten alloy crucible that I propose will not only provide robust containment for molten regolith (like in the Czochralski crystal growth method), but it will also function as the outer cylindrical cathode (of my novel concentric electrolytic cell).

In view of these specifications and with reference to FIGS. 1-5 and in a first embodiment, my invention is directed to a new type of continuous-feed rotating shell and drum molten regolith electrolysis (MRE) reactor 10 that can, simultaneously, volatilize and capture solar wind implanted volatiles (i.e., $^3$He or other noble gases) in the regolith and then electrochemically decompose, while under centrifugal action, the de-volatilized lunar regolith into oxygen, metals, and semiconductor materials. As shown, the electrolysis reactor 10 forms the heart of my regolith extraction system 8 and consists essentially of two relatively large surface area cylindrical electrodes; namely, (1) an outer rotating cylindrical shell that serves/functions as the cathode 12 (and as the reactor containment vessel), and (2) an inner concentrically positioned drum that serves/functions as the anode 14. In this novel configuration, and because the shell (cathode) 12 and concentric drum (anode) 14 are rotating (with relatively low friction because of surrounding encased ball-bearings—represented in FIG. 3 by two or three aligned circles within a box) about a central tube 16, regolith introduced into the top of the rotating reactor 10 will be flung against the inner wall 12*a* of the outer shell (cathode) 12 where it will be rapidly heated, melted, and de-volatized (i.e., $^3$He and other noble gases are liberated and removed though a first multi-passage-way rotary union 24 as shown).

Figure 4:
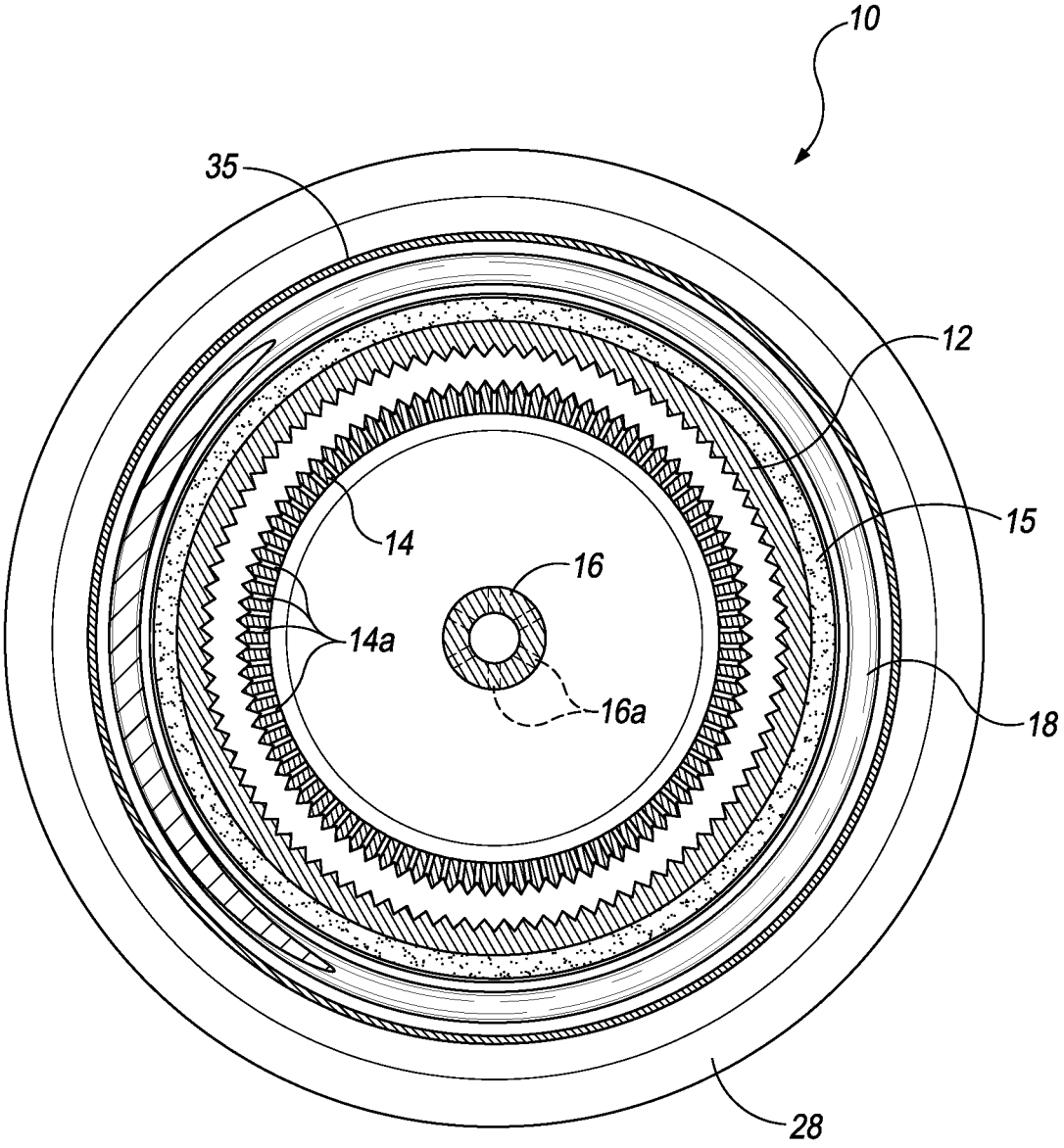
FIG. 4 is a top plan view of the centrifugal molten regolith electrolysis (MRE) reactor shown in FIG. 3.
Figure 5:
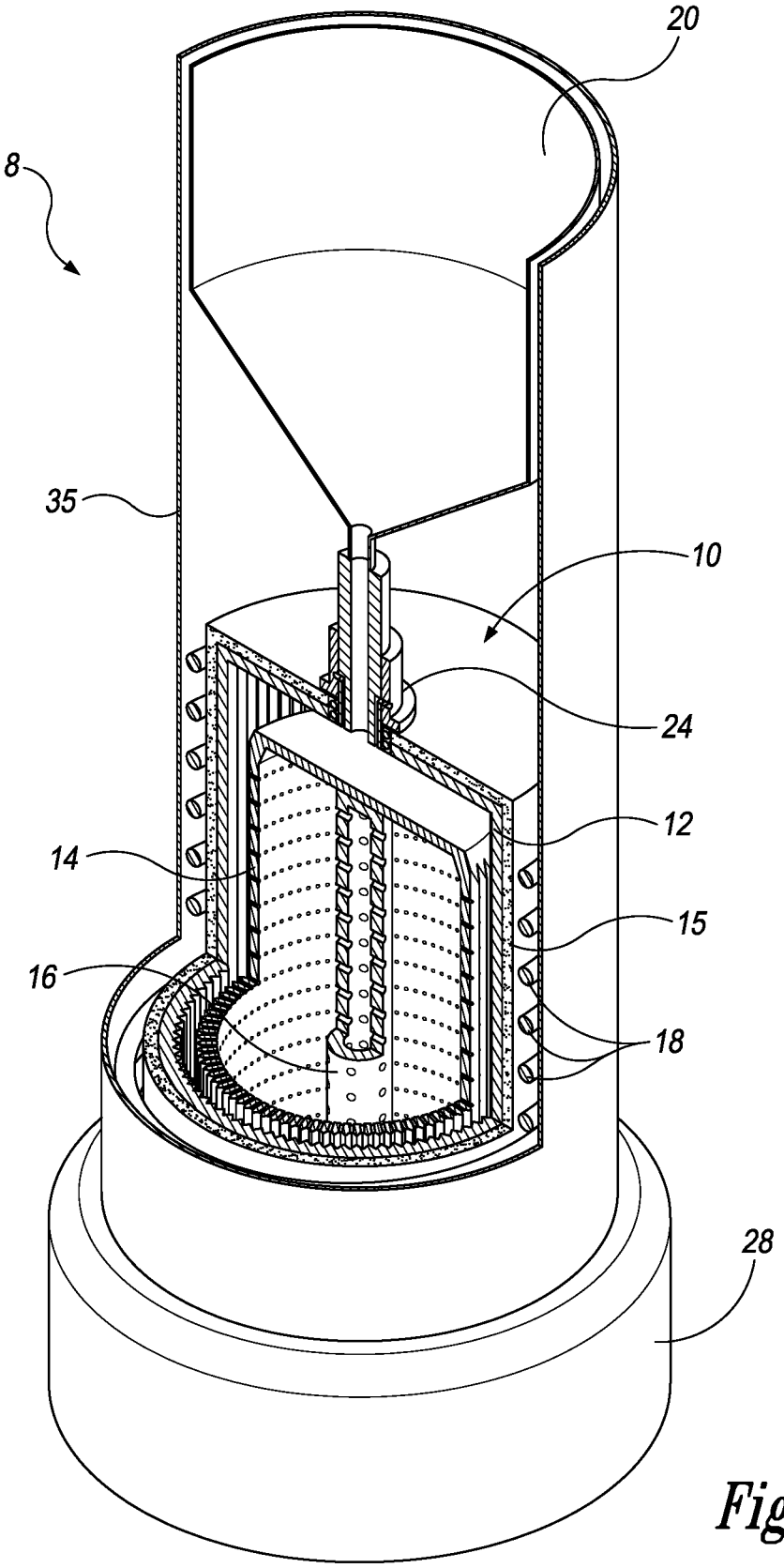
FIG. 5 is an elevated perspective cut-away view of the centrifugal molten regolith electrolysis reactor and extraction system shown in FIG. 1.

The outer shell 12 (and inner drum 14) are made of refractory metals, preferably iridium and/or alloys of tungsten (e.g., tungsten rhenium (WRe) alloys) and thus may be heated inductively (by means of a surrounding stationary induction coil 18). The supplemental heat energy provided through selective electromagnetic induction heating (in addition to the Joule heating provided by electrolysis) aids in regolith melting, flowability, and temperature control. In addition, and to substantially increase the confronting surface areas of the outer shell (cathode) 12 and the inner drum (anode) 14, it is preferred that each is of an intermeshing "saw-tooth" configuration (as best shown in FIG. 4). All possible tooth pitches, sizes, and spacings are understood to be within the scope of the present invention.

Figure 2:
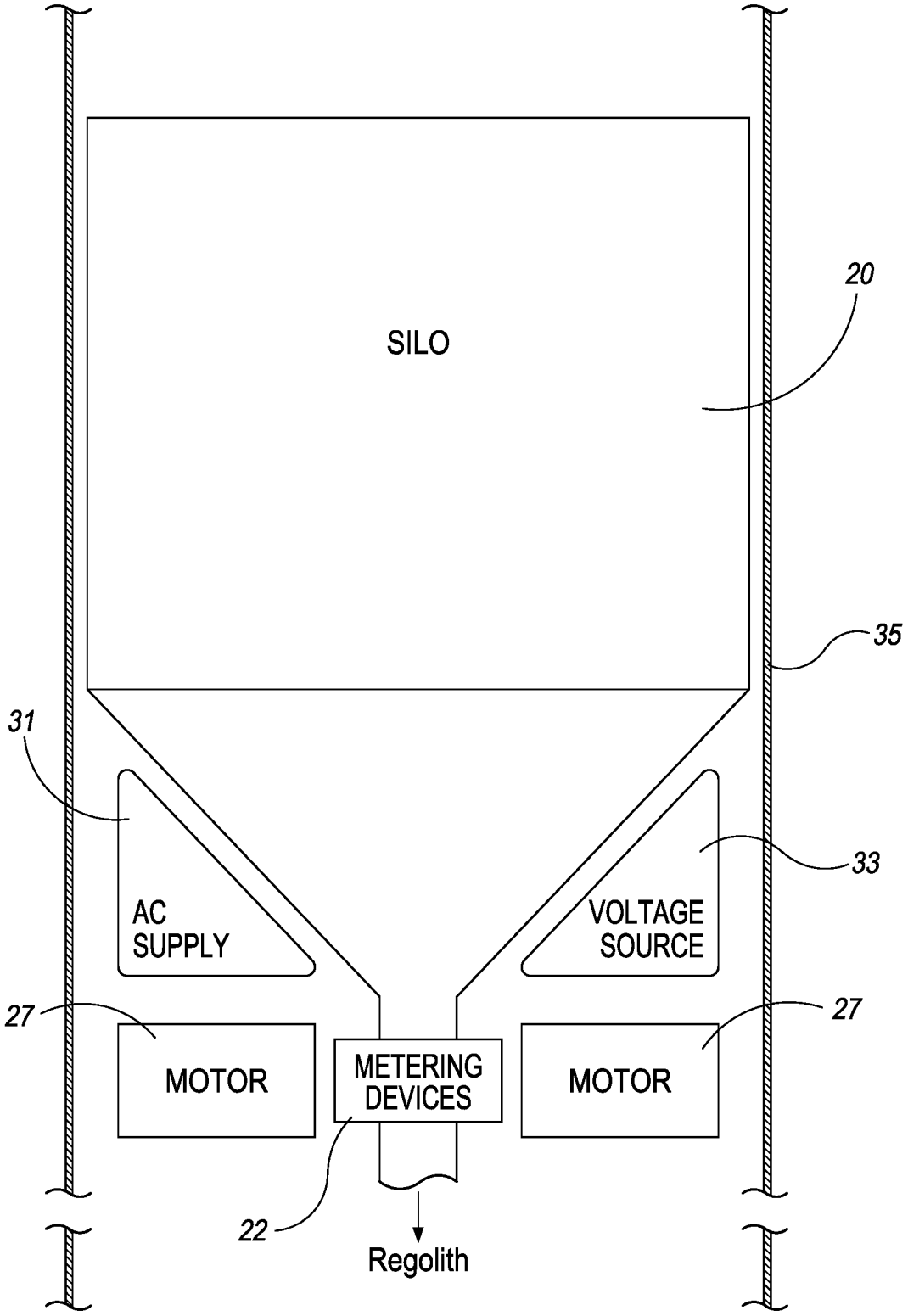
FIG. 2 is a side cross-sectional view of the top part of the centrifugal molten regolith electrolysis (MRE) reactor and extraction system shown in FIG. 1 that shows the flow direction of the regolith feed (by way of an arrow), as well as the relative positions of the metering device, the stationary overhead motor, the AC supply, and the voltage source.
Figure 3:
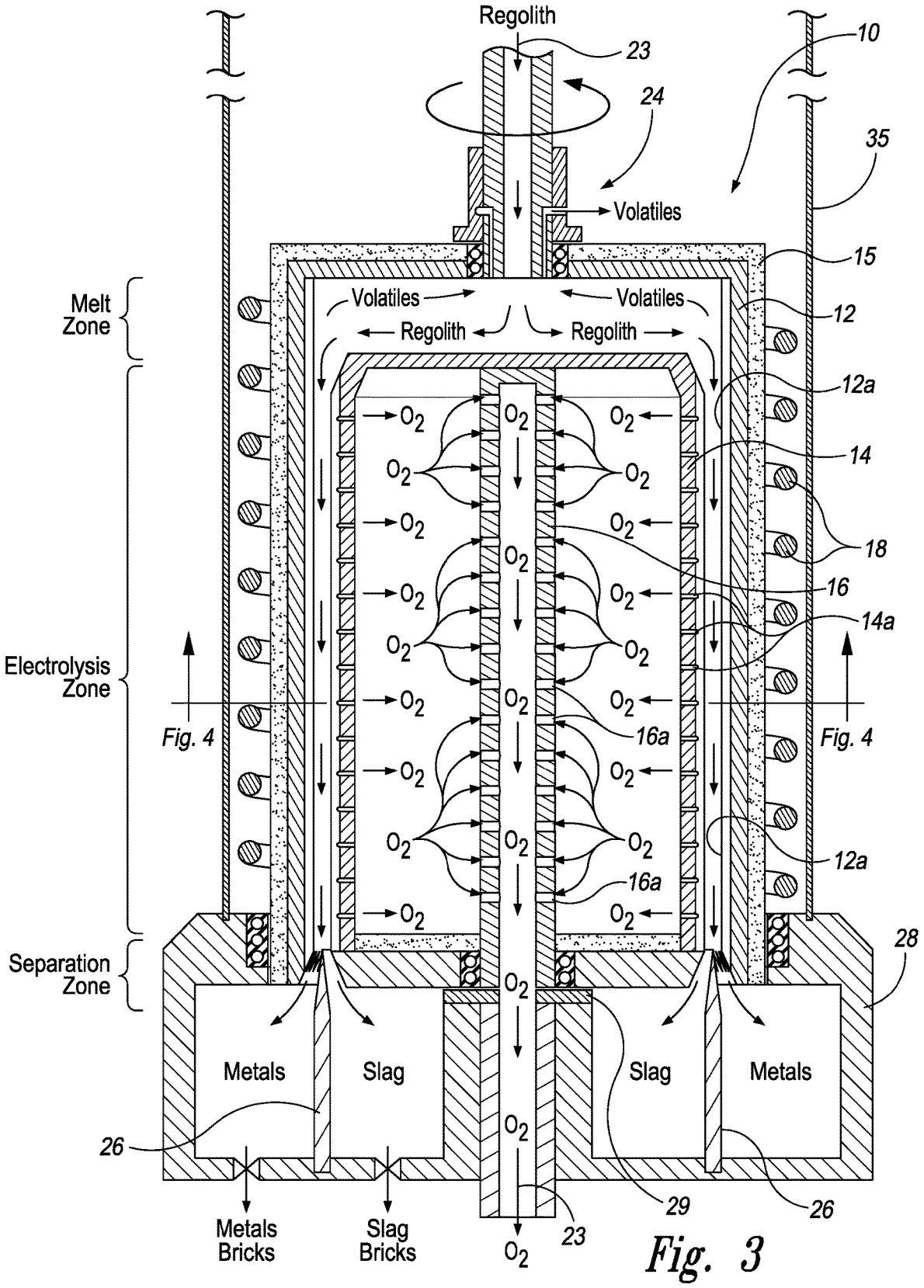
FIG. 3 is a side cross-sectional view of the bottom part of the centrifugal molten regolith electrolysis (MRE) reactor and extraction system shown in FIG. 1 that shows the flow directions (by way of arrows) of the regolith, the oxygen gas ($O_2$) reduced at the anode, and the metals and slags reduced at the cathode

As best shown in FIGS. 1-3, raw regolith feedstock (sifted/sieved and of uniform fine sandy particle consistency) is contained in an overhead silo 20, which, in turn, is connect to a metering device 22, which, in turn, continuously feeds controlled amounts of regolith into the reactor 10 by way of a central passageway of the first multi-passageway rotary union 24. The first multi-passageway rotary union 24 rotatably connects, as shown, the overhead silo 20 and the metering device 22 to the reactor 10, and allows for the continuous passage of regolith, volatiles, and electrical currents therethrough (i.e., from stationary to rotating) as shown. As shown, regolith that enters into the reactor 10 by means of the first multi-passageway rotary union 24 falls downwardly and then strikes a circular dispersion plate 25 positioned above, and integral to, the inner drum (anode) 14. After striking the dispersion plate 25, the solid granular regolith is scattered and flung radially outward until it impinges upon the inner wall 12*a* (heated via induction) of the outer shell (cathode) 12 where it begins to melt.

In order to facilitate the rapid melting of the flung regolith that impinges upon the inner wall 12*a* (heated via induction) of the outer shell (cathode) 12, small amounts of a suitable fluxing/thermite agent may preferably be admixed with the regolith feedstock (in an estimated amount of about 1-part fluxing/thermite agent per 10,000 to 100,000 parts of regolith by weight) prior to filling the overhead silo 20 (or may be metered in separately). Suitable fluxing/thermite agents include, but are not limited to, calcium fluoride ($CaF_2$) admixed with powdered aluminum (Al) on an approximate 50:50 weight percentage basis, for example. Without necessarily prescribing to any particular scientific theory, it is believed that the fluxing agent lowers the melting point and increases the electrical conductivity of the molten regolith, which, in turn, facilitates electrolysis—as well as metals and slag separation. The thermite agent, when ignited by the heat energy contained within the reactor 10, undergoes a powerful exothermic redox reaction—thereby providing additional heat energy to ensure the rapid and quick melting of the regolith fed into the reactor 10.

After melting, electrolysis begins when the molten regolith flows downwardly along the inner shell wall 12*a* and into the annular space existing between the outer shell (cathode) 12 and its inner counterpart drum (anode) 14, which is the electrolysis zone. During electrolysis and because of the centrifugal action, the denser liquid metals reduced at the outer cathode will form a thin liquid metal layer against the inner shell wall 12*a* (thereby protecting the metallic shell from oxidation), whereas the oxygen evolved (at the inner anode) will be efficiently removed from the anode 14 (through rows of anode through-holes 14*a* that are preferably positioned along the valleys between the rows of teeth that define the saw-tooth configurations) and vacuum drawn inwardly and into the central tube 16 (and out of the reactor 10 by means of second lower single-passageway rotary union 29 for subsequent liquefaction and storage).

The rotating and downwardly flowing liquid metal layer (consisting essentially of Fe, Si, Al, and Ti) reduced via electrolysis may then separated from the unreduced and less dense remaining oxide slag overlayer by means of a concentric stationary splitting ring 26. The stationary splitting ring 26 is concentrically positioned at the bottom of the electrolysis cell/reactor 10 roughly halfway between the outer cathode (shell) 12 and the inner anode (drum) 14. The splitting ring 26 is connected to, and extends upwardly, from the floor of a stationary doughnut-shaped base 28 as shown. In this configuration, the separated layers (i.e., liquid metal and molten slag) may then collected in separate underneath reservoirs formed within the interior part of the stationary doughnut-shaped base 28.

For purposes of illustration and not limitation, the following example discloses exemplary specifications, energy requirements, and inputs and outputs associated with a prospective continuous-feed centrifugal molten regolith electrolysis (MRE) reactor manufactured and operated in accordance with the present invention.

Specifications, Energy Requirements, and Inputs/Outputs:
Inputs and energy requirements
Feedstock=Lunar regolith (sifted/sieved but otherwise unprocessed)
Reactor size: H=1.8 m, D=0.9 m
Feed rate=1,000 kg/24 hrs (~11.5 grams/sec)
Residence Time=~90 min
Rotary velocity=~8-12 m/sec
Operating temp.=~1450-1650° C.
Melt cond.=~0.08 $cm^{-1}ohm^{-1}$–1 $cm^{-1}ohm^{-1}$
Electrode (sawtooth) area, A=~5 $m^2$ each
Electrode spacing, L=0.635 cm
Electric potential energies=–0.7 V to –2 V
Oxygen production efficiency=~60-90%
Total energy required=~4-5 MWhr/170 kg $O_2$
Output products (per 1,000 kg of regolith/24 hrs)
$O_2$ production=~170 kg; Volatiles=~0.1 kg
Metals production:
Fe=~194 kg
Si=~162 kg
Ti=~13 kg
Al=~1 kg
Total metals production=~370 kg
Slag production=~460 kg
Standard brick size=3⅝"×2¼"×8"
Total # of hot metal bricks produced=~90
Total # of hot slag bricks produced=~125

In a second embodiment, my invention is directed to a batch-mode centrifugal molten regolith electrolysis (MRE) reactor that similarly enables the efficient extraction of oxygen, volatiles, and metals/metalloids from extraterrestrial regolith. More specifically, and in batch mode, my high-temperature centrifugal molten regolith electrolysis (MRE) reactor can efficiently extract both (1) iron-rich metallic alloys and metalloids (consisting essentially of one or more of regolith's major constituent elemental metallic components—namely, Si, Al, Fe, Mg, Ca, and Ti) in a stratified form and in a highly manipulatable thin-wall cylinder hollow tube shaped boules, and (2) oxygen gas ($O_2$). The centrifugal action prevents the formation of dendrites (between anode 12 and the cathode 14) and minimizes production of less desirable mongrel alloys.

Thus, and with reference again to FIGS. 1, 2 and 3, my invention in a second embodiment is directed to a centrifugal molten regolith electrolysis reactor 10 that can be operated in batch mode, and that comprises four principal components; namely: (1) a rotatable concentric electrolytic cell comprising an outer cylindrical metallic cathode 14 positioned about an inner central anode 12; (2) a motor 27 sized and configured to rapidly spin (rotate) the concentric electrolytic cell 12, 14 about its central longitudinal axis 23; (3) a stationary (relative to the spinning electrolytic cell) induction coil 18 (connected to an external and stationary AC supply 31) wrapped about, and adjacent to, the rotatable concentric electrolytic cell 12, 14 (for, when selectively energized, melting regolith); and (4) a stationary voltage source 33 (for supplying an applied voltage across the electrodes of the concentric electrolytic cell 12, 14).

As shown, the cylindrical metallic cathode 12 is encased by a cylindrical holding container 15 which is preferably made of an insulative and high-temperature tolerant ceramic material (such as, for example, zirconium oxide). Similarly, the inner central drum anode 14 may positioned between two opposing (confronting) respective first and second circular insulative separation plates (not shown) that are positioned at opposite ends of the central cathode 12 and within the rotatable concentric electrolytic reactor 10. The separation plates maintain electrical separation between the outer shell cathode 12 and inner drum anode 16 when the concentric electrolytic cell is energized with an applied voltage. Finally, an outer casing 35 (e.g., carbon fiber tube or non-ferrous metal tube) encases and shields the reactor 10, the silo 20, the AC supply 31, the voltage source 33, the motor 27, and the induction coils 18.

Although not illustrated, the voltage source 33 is able to maintain a direct electrical connection to the outer shell cathode 12 and the inner drum anode 14, while stationary or rapidly spinning, by means of respective first and second electrical slip rings (not shown) that form part of the first multi-passageway rotary union 24. In electrical engineering terms, a slip ring is a device and method of making an electrical connection through a rotating assembly. In this manner, an electrical circuit is created that, when a voltage is applied, creates a potential difference between the outer shell cathode 12 and the inner drum anode 14 (irrespective of whether or not the centrifugal molten regolith electrolysis reactor 10 is stationary (stopped) or rapidly spinning). The potential difference produced by the voltage source 33 drives simultaneous electrochemical redox reactions at the cathode 12 (metal reduction) and at the anode 14 (oxygen evolution), and also imparts Joule heating to the molten regolith. Further, and in this configuration, selective winning of metals according to their oxide stabilities within the molten regolith admixture (corresponding to the deepest eutectic composition in a multicomponent alloy) can also be achieved through selective control of the applied potential (that is, Fe, Si, and Ti can be selectively won in this way, for example).

In batch mode, the rotatable concentric electrolytic reactor 10 of my invention may be operated by first partially filling the reactor 10 with solid and generally unprocessed raw regolith, melting the raw regolith by induction heating via the surrounding (and stationary) induction coil 18, followed by the simultaneous centrifugation/electrolysis of the molten regolith (and subsequent freezing to yield stratified hollow thin-walled metallic boules). In order to lower the melting temperature of lunar regolith and to enhance its conductivity, a fluorine compound such as, for example, calcium fluoride ($CaF_2$), may be optionally added to the solid regolith before melting. After melting and during subsequent centrifugation, the molten regolith contained within the reactor 10 is subjected to a strong centrifugal force and, consequently, presses up against the inner wall 12*a* of the outer cylindrical shell cathode 12. The regolith melt of various oxides is preferably maintained in a superheated molten state during centrifugal electrolysis through means of periodic external induction heating (via induction coil 18).

Although not shown, the inner drum anode 14 may be made of several parts that, collectively, are configured about a central cylindrical tube 16. The central tube 16 may be, for example, connected to a plurality of outwardly extending support spokes (not shown) that, in turn, are connected to the inner drum anode 14. As shown, the central tube 16 has rows (aligned) of respective longitudinal tube through-holes 16*a* positioned longitudinally along the central tube 16 between each of the spokes (if any). The tube through-holes 16*a* are sized and configured to allow the passage of oxygen gas ($O_2$) therethrough.

In addition, and during centrifugal electrolysis of molten regolith, oxygen produced at the inner drum anode 14 will tend to flow, due to the centrifugal action and pressure differential, inwardly through the anode through-holes 14*a* and then through the tube through-holes 16*a* and into the center tubular region (depicted by arrows) of the central tube 16. The evolved and inwardly flowing oxygen gas ($O_2$) may then be continuously extracted (drawn out) of the center tubular region of the central tube 16*a* by means of an applied vacuum acting of the central tube 16*a* via a single-passageway rotary union 29 and subsequently compressed and stored in an external liquid oxygen storage tank (not shown). In order to ensure high oxygen purity, a yttria-stabilized zirconia (YSZ) separator (filter) (also not shown) may be optionally included before the oxygen storage tank to remove any trace amounts of various oxide species (for example, SiO, TiO, MgO, CaO, etc.) that may have become entrained in the extracted/flowing oxygen gas ($O_2$) stream.

In other embodiments, my invention is also directed to the stratified metal and metalloids hollow (thin walled) cylindrical boules electrowon onto the inner wall 12*a* of the outer cathode 12. The hollow cylindrical boules of my invention, in some embodiments, exhibit unique and novel stratifications or layers of different crystalline phases of the reduced metals and metalloids. Without necessarily prescribing to any particular scientific theory, the metallic elements that are reduced (electrochemically won) on the inner wall of the outer cylindrical cathode will tend to separate/stratify yielding discrete layers of useful metals and metalloids based on iron (Fe), due to the centrifugal action—especially during the centrifugal freezing (and annealing) period (which tends to further cause the reduced metals and metalloids to form concentric stratified regions or layers of the reduced metallic components—with the more massive metallic elements tending to be generally distributed closer to the sidewall of the outer cylindrical cathode). The solid stratified metallic tubular thin shell or boule may then, in turn, be spun on a lathe (not shown) in order to selectively and progressively remove shavings therefrom (for example, from the outermost and generally more massive metallic components/alloys). Similarly, the innermost and generally less massive metallic components/silicides may likewise be separated in this manner (also for subsequent use in space construction projects).

While my invention has been described in the context of the embodiments illustrated and described herein, my invention may be embodied in other specific ways or in other specific forms without departing from its spirit or essential characteristics. Therefore, the described embodiments are to be considered in all respects as illustrative and not restrictive. The scope of my invention is defined by the appended claims rather than by the foregoing descriptions, and all changes that come within the meaning and range of equivalency of the claims are to be embraced within their scope. The jurisdictional reach of my invention extends extraterrestrially in accord with the Constitution of the United States.

I claim:

1. A centrifugal molten regolith electrolysis reactor and extraction system, comprising:

a rotatable concentric electrolytic cell comprising an outer metallic cylindrical cathode positioned about an inner metallic cylindrical anode, wherein the inner anode has a plurality of anode through-holes sized and configured to allow the passage of oxygen gas, wherein the concentric electrolytic cell has a central longitudinal axis;

a motor connected to the concentric electrolytic cell, wherein the motor is sized and configured for rapidly spinning the concentric electrolytic cell about its central longitudinal axis;

an induction or heating coil wrapped about, and adjacent to, the concentric electrolytic cell for heating the outer metallic shell cathode to a temperature above about 1,450° C.;

a voltage source for supplying an applied potential to the concentric electrolytic cell, and wherein the voltage source is electrically connected to the outer shell cathode and the inner drum anode by means of a multipassageway rotary union that is longitudinally aligned with the central longitudinal axis;

an electrical energy source for supplying electrical energy to the induction or heating coil; and a central cylindrical tube positioned along the central longitudinal axis, wherein the central tube has a plurality of through-holes sized and configured to allow the passage of oxygen gas.

2. The centrifugal molten regolith electrolysis reactor and extraction system of claim 1, further comprising a silo for storing and feeding regolith into the concentric electrolytic cell, wherein the silo is positioned above, and connected to, the concentric electrolytic cell.

3. The centrifugal molten regolith electrolysis reactor and extraction system of claim 2, wherein the cathode and the anode are cylindrical and made of one or more refractory metals.

4. The centrifugal molten regolith electrolysis reactor and extraction system of claim 3, wherein the one or more refractory metals is one or more of iridium and a tungsten rhenium alloy.

* * * * *